US012042744B2

(12) United States Patent
Wang et al.

(10) Patent No.: US 12,042,744 B2
(45) Date of Patent: Jul. 23, 2024

(54) TOUCH PRESSURE-RELIEVING TOY

(71) Applicant: DONGGUAN YIQUN ZHIHUI ELECTRONIC TECHNOLOGY CO., LTD., Dongguan (CN)

(72) Inventors: Liu Wang, Ji'an (CN); Yiqun Tang, Ji'an (CN); Shenglian Zhang, Dongguan (CN)

(73) Assignee: DONGGUAN YIQUN ZHIHUI ELECTRONIC TECHNOLOGY CO., LTD., Dongguan (CN)

( * ) Notice: Subject to any disclaimer, the term of this patent is extended or adjusted under 35 U.S.C. 154(b) by 234 days.

(21) Appl. No.: 17/844,085

(22) Filed: Jun. 20, 2022

(65) Prior Publication Data

US 2022/0314138 A1 Oct. 6, 2022

(51) Int. Cl.
*A63H 33/00* (2006.01)
*A63H 29/22* (2006.01)
*A63H 29/24* (2006.01)

(52) U.S. Cl.
CPC ..... *A63H 29/22* (2013.01); *A63H 29/24* (2013.01); *A63H 33/00* (2013.01)

(58) Field of Classification Search
CPC ..... A63H 33/00
See application file for complete search history.

(56) References Cited

U.S. PATENT DOCUMENTS 3,599,367 A * 8/1971 Taylor ..... A63H 33/30 446/472
3,617,056 A * 11/1971 Herbold ..... A63B 21/00196 446/233
4,236,343 A * 12/1980 Wildman ..... A63H 33/3072 446/145
4,334,384 A * 6/1982 Rogers ..... A63H 33/30 446/397
4,582,317 A * 4/1986 Provenzano, Jr. ..... A63H 3/003 446/390
4,941,857 A * 7/1990 Fujimaki ..... A63H 3/28 446/353
5,074,820 A * 12/1991 Nakayama ..... A63H 33/00 601/60
5,152,708 A * 10/1992 Claugus ..... A63H 37/00 446/484
5,199,920 A * 4/1993 Christen ..... A63H 5/00 446/419
6,899,589 B1 * 5/2005 Lund ..... A63H 11/06 446/379

* cited by examiner

*Primary Examiner* — John A Ricci

(57) ABSTRACT

The present disclosure belongs to the field of toys, and in particular discloses a touch pressure-relieving toy, including an insulating shell, wherein a vibration component and at least one pair of copper foils are accommodated in the insulating shell, the same pair of copper foils are covered on inner walls of the insulating shell at intervals, all the copper foils are electrically connected to the vibration component, and a silicone sleeve is sleeved outside the insulating shell. According to the present disclosure, a human hand approaches the same pair of copper foils to form touch sensing to control the vibration component to vibrate in the insulating shell, so that the fun can be improved while a user relieves his/her pressure.

10 Claims, 6 Drawing Sheets

TOUCH PRESSURE-RELIEVING TOY

TECHNICAL FIELD

The present disclosure belongs to the technical field of toys, and in particular relates to a touch pressure-relieving toy.

BACKGROUND

With the pace of contemporary social life getting faster and faster, it is necessary to both face the burden of life and overcome a hard time at work. If the pressure cannot be resolved in time, people will easily get sick psychologically and physically, such as depression, irritability, anxiety and other negative emotions. At this time, people need to relieve anxiety and find a suitable way to relieve the pressure.

Many people will release the pressure by playing with various pressure-relieving toys, and most of the existing pressure-relieving toys bring visual, sensory and auditory impacts to people by hard pressing, ravaging, colliding, etc. (such as a soft rubber ball). Stimulating the brain plays a role in venting inner anger and resistance, thereby relieving the pressure and relaxing the mood, which can although relieve the pressure to a certain extent, but has single function and lacks interest.

Therefore, the inventor is committed to designing a pressure-relieving toy to solve the above-mentioned problems.

SUMMARY

The present disclosure aims to provide a touch pressure-relieving toy, which can not only be pressed, but also generate vibration, thus improving interest while relieving the pressure.

In order to achieve the above-mentioned purpose, the present disclosure adopts a technical solution as follows:

A touch pressure-relieving toy, including an insulating shell, wherein a vibration component and at least one pair of copper foils are accommodated in an inner cavity of the insulating shell, the same pair of copper foils are covered on inner walls of the insulating shell at intervals, all the copper foils are electrically connected to the vibration component, and a silicone sleeve is sleeved outside the insulating shell.

As an improvement of the touch pressure-relieving toy of the present disclosure, the same pair of copper foils are insulated by a separation table, which is formed by extending inwardly from the inner walls of the insulating shell.

As an improvement of the touch pressure-relieving toy of the present disclosure, the inner walls of the insulating shell are provided with fixing tables, the separation tables are arranged on the fixing tables in an inclined manner, and the same pair of copper foils are attached to the corresponding fixing tables.

As an improvement of the touch pressure-relieving toy of the present disclosure, there are two pairs of copper foils, which are respectively covered on two opposite inner walls of the insulating shell.

As an improvement of the touch pressure-relieving toy of the present disclosure, the insulating shell includes a bottom shell and an upper cover, with the upper cover being covered on the bottom shell to form the inner cavity, and the two pairs of copper foils are respectively covered on the inner walls of both the bottom shell and the upper cover.

As an improvement of the touch pressure-relieving toy of the present disclosure, the vibration component includes a motor, with the motor being fixed in the insulating shell by means of a base, and an output end of the motor being provided with an eccentric wheel.

As an improvement of the touch pressure-relieving toy of the present disclosure, an outer wall of the silicone sleeve is provided with marking holes, with the positions of the marking holes corresponding to the positions of the same pair of copper foils.

As an improvement of the touch pressure-relieving toy of the present disclosure, the outer wall of the silicone sleeve is provided with a groove of half circle, and a plurality of anti-skid tables are arranged at intervals in the groove along the axial direction of the silicone sleeve.

As an improvement of the touch pressure-relieving toy of the present disclosure, the outer wall of the silicone sleeve is provided with a plurality of circles of outer chutes, which are arranged in a circle around the groove.

As an improvement of the touch pressure-relieving toy of the present disclosure, two opposite ends of the silicone sleeve are respectively provided with a switch and a pair of charging pins, with the switch being electrically connected to the vibration component, and the pair of charging pins being electrically connected to the vibration component by means of a battery.

Compared with the prior art, according to the touch pressure-relieving toy of the present disclosure, a human hand approaches the same pair of copper foils to form touch sensing, so as to control the vibration component to vibrate in the insulating shell. At the same time, a silicone sleeve is sleeved outside the insulating shell, which is convenient for pressing and playing, and improves the fun while a user relieves his/her pressure, thus adding fun to a busy life.

REFERENCE NUMBER LISTING

1, Silicone Sleeve; 11, Groove; 111, Anti-skid Table; 112, First Marking Hole; 12, Outer Chute; 13, Second Marking Hole; 14, Switch; 15, Charging Pin; 2, Bottom Shell; 21, Lower Fixing Table; 211, Lower Separation Table; 3, Base; 31, Positioning Plate; 32, Release Groove; 4, Motor; 41, Eccentric Wheel; 5, Cover Plate; 6, Battery; 7, Upper Cover; 71, Upper Fixing Table; 711, Upper Separation Table; 8, First Copper Foil; and 9, Second Copper Foil.

DETAILED DESCRIPTION

Embodiments of the present disclosure are specifically illustrated below in conjunction with the accompanying drawings, which are for reference and illustration only and do not constitute a limitation on the scope of patent protection of the present disclosure.

Referring to FIG. 1 to FIG. 7, disclosed is a touch pressure-relieving toy, including an insulating shell, at least one pair of copper foils, a vibration component and a silicone sleeve 1, wherein the vibration component and the at least one pair of copper foils are all accommodated in an inner cavity of the insulating shell, the same pair of copper foils are covered on inner walls of the insulating shell at intervals, all the copper foils are electrically connected to the vibration component, and the silicone sleeve 1 is sleeved outside the insulating shell. When a human hand touches and appropriately presses the silicone sleeve 1, touch sensing is formed between the human hand and the same pair of copper foils, so as to control the vibration component to vibrate in the insulating shell.

Figure 1:
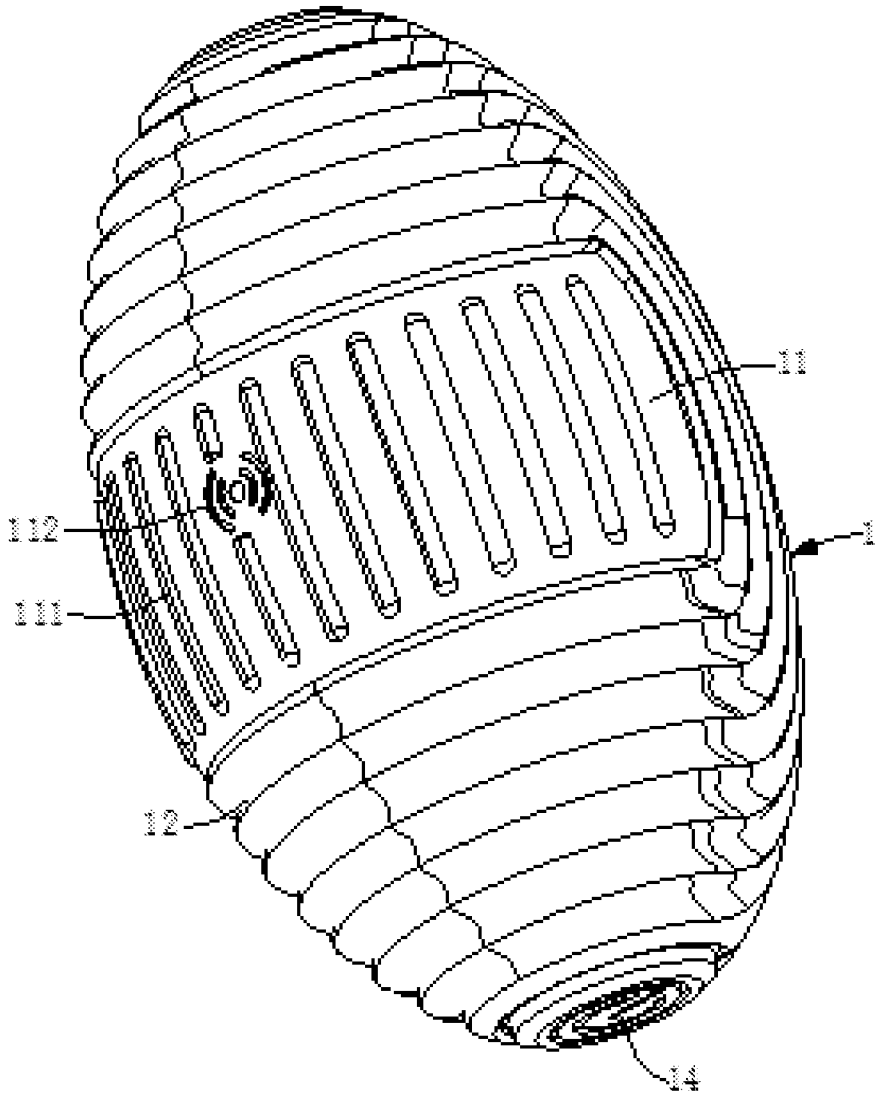
FIG. 1 is a stereoscopic enlarged view of a touch pressure-relieving toy according to the present disclosure.
Figure 2:
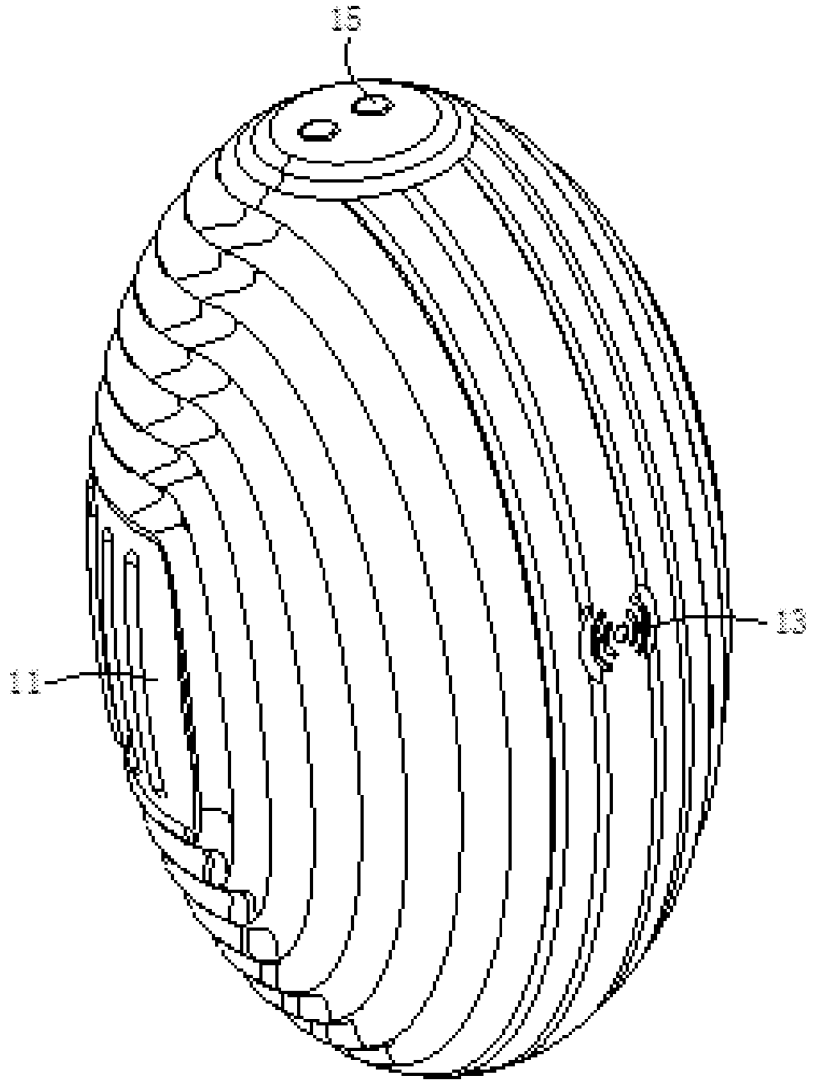
FIG. 2 is a stereoscopic enlarged view of another perspective of a touch pressure-relieving toy according to the present disclosure.

Referring to FIG. 1 and FIG. 2, the silicone sleeve 1 is ellipsoid-shaped, the outer wall of the silicone sleeve 1 is provided with a groove 11 of half circle, a plurality of anti-skid tables 111 are arranged at intervals in the groove 11 along the axial direction of the silicone sleeve 1, the outer wall of the silicone sleeve 1 is provided with a plurality of circles of outer chutes 12 that are arranged in a circle around the groove 11, the outer wall of the silicone sleeve 1 is provided with two marking holes that play the role of touch marking, the two marking holes 112 are specifically a first marking hole 112 and a second marking hole 13, which are respectively located on two opposite sides of the outer wall of the silicone sleeve 1, wherein the first marking hole 112 is located at the bottom of the groove 11, and the second marking hole 13 is located outs of the groove 11.

Referring to FIG. 3, FIG. 4, FIG. 5 and FIG. 7, the insulating shell is ellipsoid-shaped and includes a bottom shell 2 and an upper cover 7, wherein the upper cover 7 is covered on the bottom shell 2 to form the inner cavity, the bottom shell 2 and the upper cover 7 are made of insulating plastic material, the covering surface of the bottom shell 2 is concavely arranged to form the shape of a shell, the inner wall of the bottom shell 2 is protruded with a lower fixing table 21, the lower fixing table 21 is provided with an arc-shaped lower separation table 211, the lower separation table 211 is arranged in an inclined manner and formed by the lower fixing table 21 extending inwardly, the covering surface of the upper cover 7 is concavely arranged to form the shape of a shell, the inner wall of the upper cover 7 is protruded with an upper fixing table 71, the upper fixing table 71 is protruded with an arc-shaped upper separation table 711, and the upper separation table 711 is arranged in an inclined manner and formed by the upper fixing table 71 extending inwardly.

Referring to FIG. 3, FIG. 4, FIG. 5 and FIG. 7, since there is an inherent parasitic capacitance between a pair of spaced copper foils, when a finger (or other conductors) gets close, a new capacitance is generated between the finger and the pair of copper foils. The new capacitance is equivalent to being connected in parallel to the original parasitic capacitance. One of the copper foils is connected to analog I/O of a PSoC, and the other is grounded, so that the presence of the finger can be judged by measuring the change in the capacitance. The copper foil connected to the PSoC is a capacitive sensor (Capacitive Sensor), which needs to be covered with an insulating shell. By building a circuit inside the PSoC and using the program of a built-in 8-bit processor to control the operation of the circuit, the change in the capacitance can be converted into a change in a count value, and then into the amount of switching required for a key action. Touch sensing (CapSense touch sensing technology) is realized according to the principle of capacitive sensing and the technology of a relaxation oscillator. According to the present embodiments, in order to realize simultaneous contact sensing between two opposite sides of the pressure-relieving toy, there are preferably two pairs of copper foils, which are respectively covered on two opposite inner walls of the insulating shell. In the present embodiments, the same pair of copper foils have the same structure, and the two pairs of copper foils are specifically a pair of first copper foils 8 and a pair of second copper foils 9, wherein the pair of first copper foils 8 are attached to the lower fixing table 21 of the bottom shell 2, and the pair of first copper foils 8 are insulated and separated by the lower separation table 211, the pair of second copper foils 9 are attached to the upper fixing table 71 of the upper cover 7, and the pair of second copper foils 9 are insulated and separated by the upper separation table 711, the position of the first marking hole 112 corresponds to the positions of the pair of first copper foils 8, and at the same time, the position of the second marking hole 13 corresponds to the positions of the pair of second copper foils 9. By touching the first marking hole 112 and the second marking hole 13 by hand, the vibration component can be triggered to vibrate by means of the two pairs of copper foils.

Figure 3:
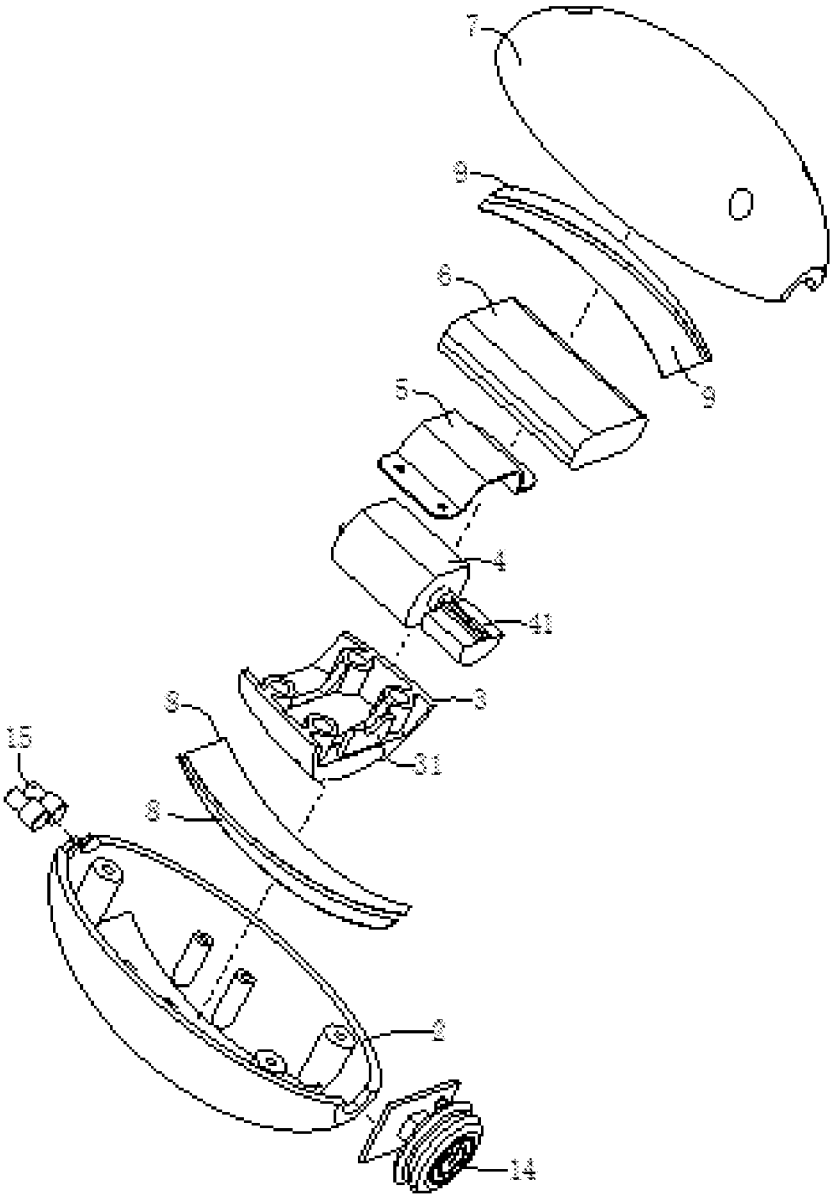
FIG. 3 is a stereoscopic exploded view of a touch pressure-relieving toy according to the present disclosure after the silicone sleeve is removed.
Figure 4:
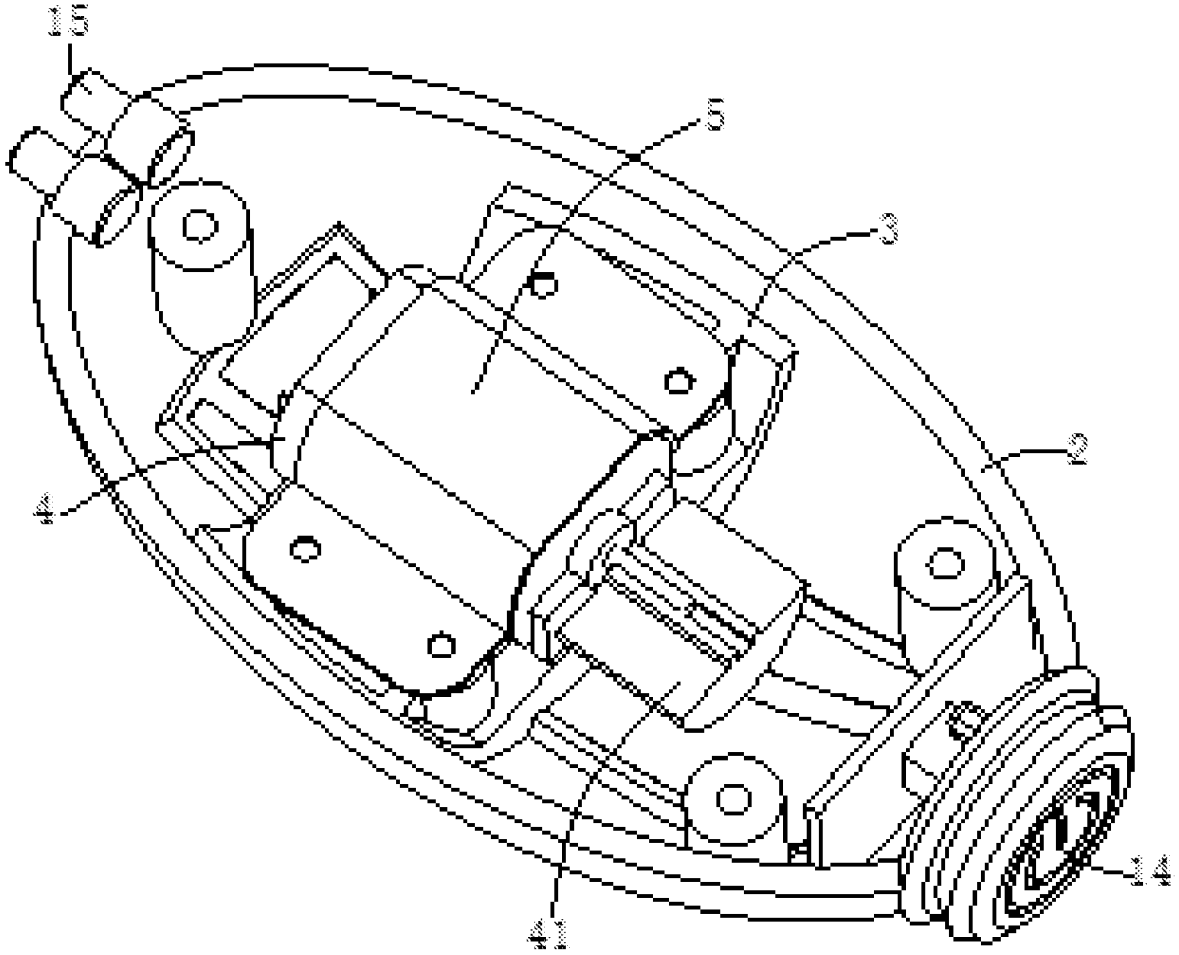
FIG. 4 is a stereoscopic assembled enlarged view of a bottom shell and a vibration component according to the present disclosure.
Figure 5:
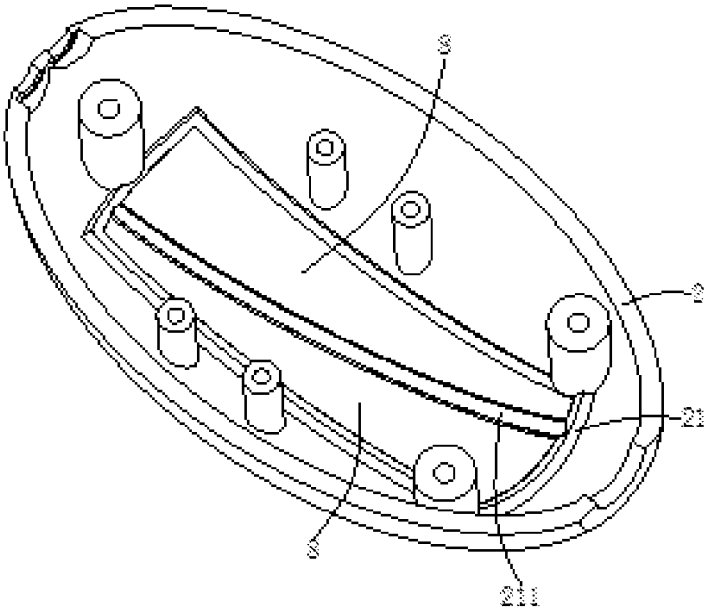
FIG. 5 is a stereoscopic enlarged view of a bottom shell according to the present disclosure.
Figure 6:
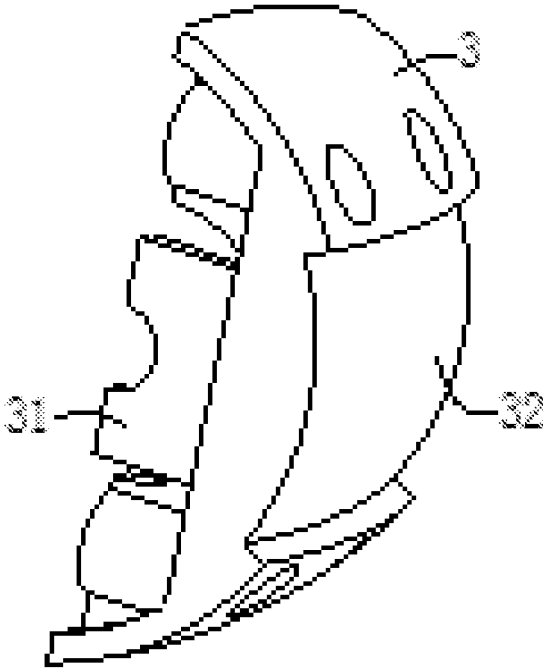
FIG. 6 is a stereoscopic enlarged view of a base according to the present disclosure.
Figure 7:
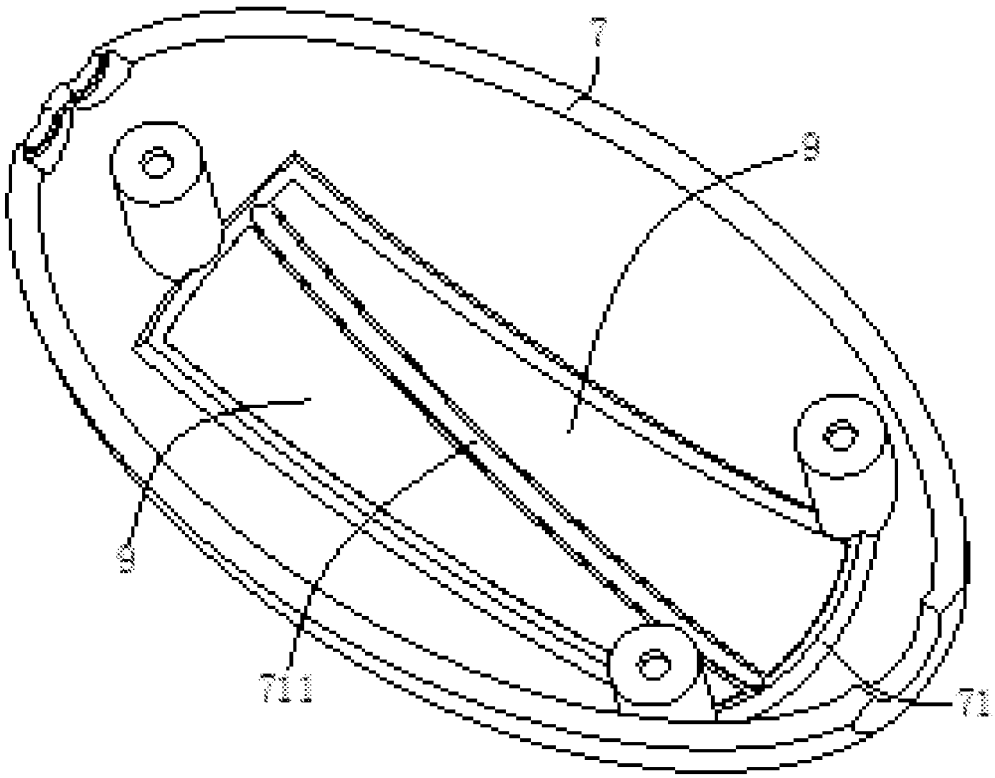
FIG. 7 is a stereoscopic enlarged view of an upper cover according to the present disclosure.

Referring to FIG. 3 and FIG. 4, a base 3 is fixed on the inner wall of the bottom shell 2, an end surface of the base 3 is provided with a positioning plate 31, the positioning plate 31 is provided with a positioning groove, the outer wall of the base 3 is provided with a release groove 32, the centers of the pair of first copper foils 8, the lower separation table 211 and the lower fixing table 21 are all located in the release groove 32, a cover plate 5 is also accommodated in the inner cavity, the cover plate 5 is fixedly covered on the bottom shell 2, and the cover plate 5 is shell-shaped and has a concave covering portion.

Referring to FIG. 3 and FIG. 4, the vibration component includes a motor 4 and an eccentric wheel 41, wherein the motor 4 is located between the cover plate 5 and the base 3, the end of the motor 4 is located in a positioning groove on the positioning plate 31, and the eccentric wheel 41 is located at an output end of the motor 4 and extends out of the cover plate 5 and the base 3.

Referring to FIG. 1 to FIG. 4, a battery 6 is also accommodated in the inner cavity of the insulating shell, the battery 6 is outwardly covered with EVA and is located directly above the motor 4, two opposite ends of the silicone sleeve 1 are respectively provided with a switch 14 and a pair of charging pins 15, the switch 14 and the pair of charging pins 15 are specifically located between the bottom shell 2 and the upper cover 7, the motor 4 and the pair of charging pins 15 are all electrically connected to the battery 6, the pair of charging pins 15 can charge the battery 6 by means of an external circuit, a circuit board is provided in the inner cavity and located on the side of the switch 14, both the switch 14 and the motor 4 are electrically connected to the circuit board, the switch 14 can directly control the motor 4 to operate normally, and the pair of first copper foils 8 and the pair of second copper foils 9 are all connected to the circuit board. When a finger touches the first marking hole 112 and the second marking hole 13, the pair of first copper foils 8 and the pair of second copper foils 9 respectively transmit sensing signals to the circuit board, thereby controlling the operation of the motor 4.

Referring to FIG. 1 to FIG. 7, the working principle of the touch pressure-relieving toy of the present disclosure is as follows: by holding the pressure-relieving toy and appropriately pressing the silicone sleeve 1, when a finger touches the first marking hole 112 and the second marking hole 13, the pair of first copper foils 8 and the pair of second copper foils 9 respectively transmit sensing signals to the circuit board, so as to control the motor 4 to drive the eccentric wheel 41 to rotate to generate a shaking force, thus realizing the vibration of the entire pressure-relieving toy. When the finger gets closer or has a larger area, an electronic parameter will be generated. Data are read by means of a chip on the circuit board, thereby controlling and adjusting the vibration frequency.

According to the touch pressure-relieving toy of the present disclosure, a human hand approaches the same pair of copper foils to form touch sensing, so as to control the vibration component to vibrate in the insulating shell. At the same time, a silicone sleeve 1 is sleeved outside the insulating shell, which is convenient for pressing and playing, and improves the fun while the user relieves his/her pressure, thus adding fun to a busy life.

The above disclosed are only preferred embodiments of the present disclosure, and cannot be used to limit the protection scope of the rights of the present disclosure. Therefore, equivalent changes made in the scope of the patent application of the present disclosure still fall within the scope covered by the present disclosure.

The invention claimed is:

1. A touch pressure-relieving toy, comprising an insulating shell, wherein a vibration component and at least one pair of copper foils are accommodated in an inner cavity of the insulating shell, the same pair of copper foils are covered on inner walls of the insulating shell at intervals, all the copper foils are electrically connected to the vibration component, and a silicone sleeve is sleeved outside the insulating shell.

2. The touch pressure-relieving toy according to claim 1, wherein the same pair of copper foils are insulated by a separation table, which is formed by extending inwardly from the inner walls of the insulating shell.

3. The touch pressure-relieving toy according to claim 2, wherein the inner walls of the insulating shell are provided with fixing tables, the separation tables are arranged on the fixing tables in an inclined manner, and the same pair of copper foils are attached to the corresponding fixing tables.

4. The touch pressure-relieving toy according to claim 1, wherein there are two pairs of copper foils, which are respectively covered on two opposite inner walls of the insulating shell.

5. The touch pressure-relieving toy according to claim 4, wherein the insulating shell comprises a bottom shell and an upper cover, with the upper cover being covered on the bottom shell to form the inner cavity, and the two pairs of copper foils are respectively covered on the inner walls of both the bottom shell and the upper cover.

6. The touch pressure-relieving toy according to claim 1, wherein the vibration component comprises a motor, with the motor being fixed in the insulating shell by means of a base, and an output end of the motor being provided with an eccentric wheel.

7. The touch pressure-relieving toy according to claim 1, wherein an outer wall of the silicone sleeve is provided with marking holes, with the positions of the marking holes corresponding to the positions of the same pair of copper foils.

8. The touch pressure-relieving toy according to claim 1, wherein the outer wall of the silicone sleeve is provided with a groove of half circle, and a plurality of anti-skid tables are arranged at intervals in the groove along the axial direction of the silicone sleeve.

9. The touch pressure-relieving toy according to claim 8, wherein the outer wall of the silicone sleeve is provided with a plurality of circles of outer chutes, which are arranged in a circle around the groove.

10. The touch pressure-relieving toy according to claim 1, wherein two opposite ends of the silicone sleeve are respectively provided with a switch and a pair of charging pins, with the switch being electrically connected to the vibration component, and the pair of charging pins being electrically connected to the vibration component by means of a battery.

* * * * *